US006247655B1

(12) United States Patent
Filiz et al.

(10) Patent No.: US 6,247,655 B1
(45) **Date of Patent: *Jun. 19, 2001**

(54) FUEL INJECTION VALVE FOR INTERNAL COMBUSTION ENGINES

(75) Inventors: Erguen Filiz, Neuenstadt; Friedrich Boecking, Stuttgart, both of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

This patent is subject to a terminal disclaimer.

(21) Appl. No.: 08/609,328

(22) Filed: Mar. 1, 1996

(30) Foreign Application Priority Data

Mar. 2, 1995 (DE) ..... 195 07 188

(51) Int. Cl.[7] ..... F02M 59/00

(52) U.S. Cl. ..... 239/533.2; 239/533.3; 239/585.1; 251/129.15

(58) Field of Search ..... 239/533.1–533.14, 239/585.1, 585.2, 585.4, 584; 251/129.15, 129.21

(56) References Cited

U.S. PATENT DOCUMENTS

| | | | | |
|---|---|---|---|---|
| 4,069,978 | * | 1/1978 | El Moussa | 239/533.2 |
| 4,177,948 | * | 12/1979 | Schaffitz et al. | 239/533.3 |
| 4,275,844 | * | 6/1981 | Grgurich et al. | 239/533.3 |
| 4,819,871 | * | 4/1989 | Kronberger et al. | 239/533.3 |
| 4,917,307 | * | 4/1990 | Baxter et al. | 239/533.3 |
| 5,026,462 | | 6/1991 | Butterfield et al. | 204/129.55 |
| 5,467,924 | * | 11/1995 | Buescher et al. | 239/533.3 |

FOREIGN PATENT DOCUMENTS

| | | | | |
|---|---|---|---|---|
| 1212352 | | 2/1960 | (DE) . | |
| 3901183 | * | 6/1990 | (DE) | 239/533.3 |
| 0370659 | | 12/1992 | (EP) . | |
| 2127097 | | 4/1944 | (GB) . | |
| 63-302173 | | 9/1988 | (JP) . | |
| 67459 | * | 3/1990 | (JP) | 239/533.2 |
| 17769 | * | 1/1992 | (JP) | 239/533.2 |
| 5-231267 | | 9/1993 | (JP) . | |
| 5-231272 | | 9/1993 | (JP) . | |
| 5-240129 | | 9/1993 | (JP) . | |
| M1529 | | 9/1993 | (JP) . | |
| 612733 | | 5/1916 | (SE) . | |
| 981666 | * | 12/1982 | (SU) | 239/533.3 |

* cited by examiner

*Primary Examiner*—Andres Kashnikow
*Assistant Examiner*—Lisa Ann Douglas
(74) *Attorney, Agent, or Firm*—Ronald E. Greigg; Edwin E. Greigg

(57) ABSTRACT

A fuel injection valve for internal combustion engines, with a valve member which is guided axially displaceably in a bore of a valve body and which has, at its end on the combustion space side, a conical valve sealing face, the conical valve sealing face cooperates with a conical valve seat face at that end of the bore on the combustion space side. A blind hole or a conical region adjoins said bore on the combustion space side, with a pressure space that opens onto the valve seat and located between the valve member shank and the wall of the bore, and with at least one injection duct which leads from an inner wall of the injection valve. The inner wall being located downstream of the valve seat. To form the injection jet, the entry regions of the injection duct are rounded, an upper entry region which faces the pressure space having a large radius (RA) and a lower entry region which faces away from the pressure space having a smaller radius (RB). At the same time, the size of the radius (RA) is 0.02 to 0.3 times and that of the radius (RB) 0.01 to 0.05 times the diameter (D) of the injection duct (23).

6 Claims, 1 Drawing Sheet

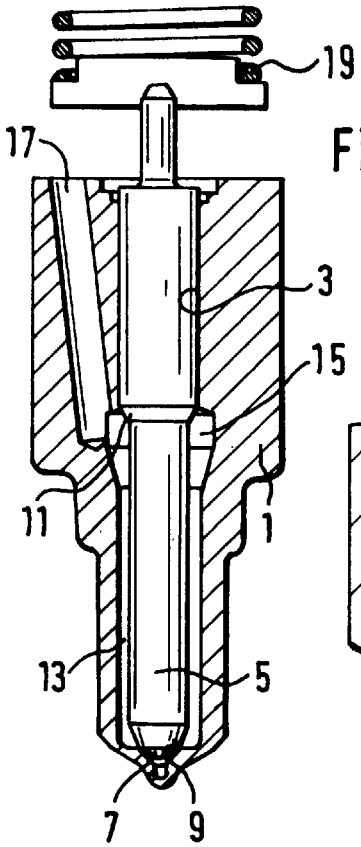
Fig. 1
Fig. 2
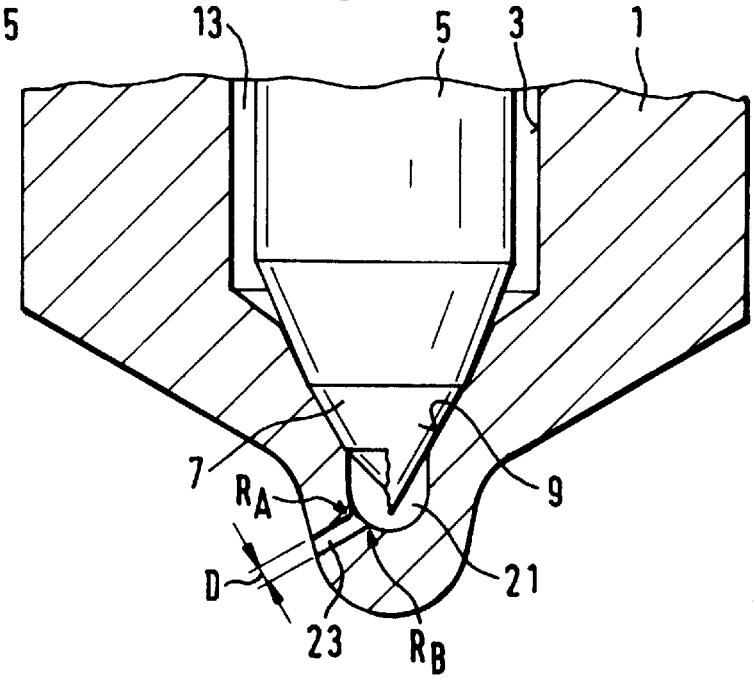
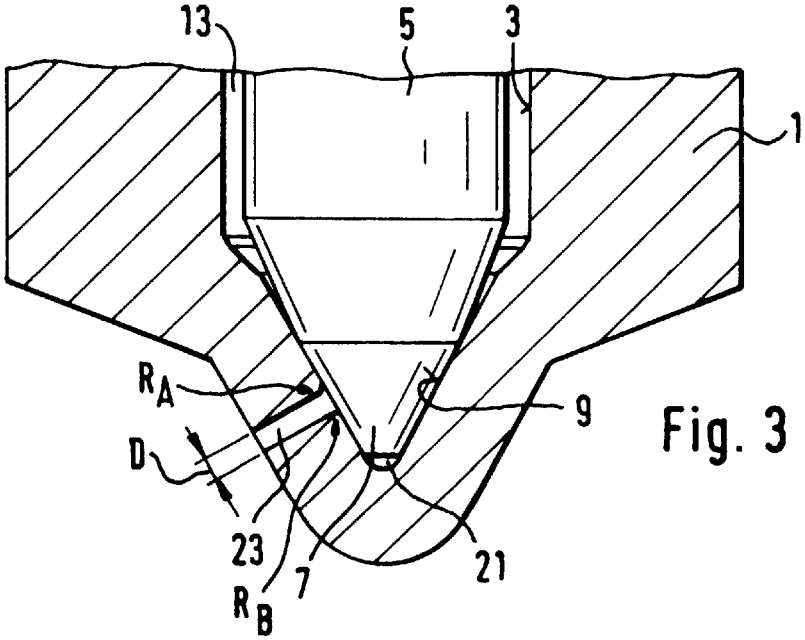
Fig. 3

FUEL INJECTION VALVE FOR INTERNAL COMBUSTION ENGINES

PRIOR ART

The invention relates to a fuel-injection valve for internal combustion engines. In a fuel injection valve known from EP 0,370,659, a piston-shaped valve member is guided axially displaceably in a bore of a valve body, said bore merging on the combustion space side into a blind hole via a conical region. The valve member has, at its lower end facing the combustion space of the internal combustion engine to be supplied, a conical sealing face, by means of which it cooperates with a conical valve seat on the conical region of the bore. Depending on the design of the injection valve, at least one injection duct leads off, downstream of the valve seat, from the blind hole or from the conical region of the bore in the valve body. Provided between the shank of the valve member and the wall of the bore is a pressure space which adjoins the valve seat face via a pressure duct formed by an annular gap between the valve member and bore. Furthermore, the valve member possesses in a known way, in the region of the pressure space, a pressure shoulder, on which the fuel high pressure flowing into the pressure space via a pressure conduit is applied and thus lifts off the valve member from its valve seat counter to the force of a return spring.

To form the injection jet, the inner end of the injection duct on the known injection valve is made funnel-shaped, in that the transition between the blind hole or conical region and the injection duct is rounded with a fixed radius, and this radius which, in section, extends through the longitudinal axis of the injection duct is designed in such a way that it merges tangentially into an injection jet contraction within the injection duct. At the same time, an edge remains between the rounded part and the cylindrical part of the injection duct and between the rounded part and the wall of the blind hole or of the conical region. Furthermore, this assists a contraction of the jet, reduces the throughflow rate through the injection duct and diminishes the compactness of the emerging fuel jet in a disadvantageous way.

The disadvantage of this form of the known injection port is, moreover, that the injection hole length actually effective for forming the jet is reduced as a result of the funnel-shaped entry region, in such a way that now even the length is no longer sufficient to achieve a directional injection jet. On the contrary, the injection jet of the known fuel injection valve becomes bushy and therefore does not reach a sufficient depth of penetration into the combustion space of the internal combustion engine to be supplied.

ADVANTAGES OF THE INVENTION

In contrast to this, the advantage of the fuel injection valve according to the invention, is that, as a result of the edge-free and only slight rounding of the entry regions of the injection duct, the actually effective injection hole length of the injection port is not reduced, so that a widening of the injection jet is avoided. The relatively small radii nevertheless, at the same time, already allow a uniform inflow of the fuel into the injection ports, with the result that the swirls at the entrance can be reduced considerably in comparison with conventional injection valves with non-rounded entry edges at the injection hole. In this way, a directional homogeneous injection jet is achieved by virtue of the design according to the invention of the radii at the entry region of the injection ducts.

Moreover, the notch effect is reduced as a result of the rounding of the entry edges of the injection hole, thereby leading to an increase in the high-pressure strength in the region of the tip, of the blind hole and of the injection hole to more than 2000 bar. The rounding can take place, for example, mechanically, hydraulically or electrochemically, this machining leading additionally to an increase in the tip strength, since the edge oxidation in the heart part is thereby removed.

An especially favorable shape of the injection jet is obtained when the radius in the upper entry region is 0.02 to 0.3 times and the radius in the lower entry region 0.01 to 0.05 times the diameter of the injection hole. A further improvement in the above-described formation of the injection jet is achieved when the wall thickness of the valve body, said wall thickness determining the length of the injection duct, is between 0.6 and 1.4 mm in the region of the injection duct. The measure described for the advantageous formation of as directional an injection jet as possible is feasible both on injection valves of the blind-hole nozzle type and on injection valves of the seat-hole nozzle type, in the case of blind-hole nozzles the axis of the injection duct being tilted preferably in the direction of the valve member out of a perpendicular to the wall of the blind-hole bore.

Further advantages and advantageous embodiments of the subject of the invention can be taken from the description, the drawing and the patent claims.

BRIEF DESCRIPTION OF THE DRAWING

Two exemplary embodiments of the fuel injection valve according to the invention for internal combustion engines are represented in the drawing and are explained in more detail below.

FIG. 1 shows a section through the injection valve,

FIG. 2 illustrates a first exemplary embodiment in an enlarged detail from FIG. 1, in which the injection valve is designed as a blind-hole nozzle, and FIG. 3 a illustrates a second exemplary embodiment similar to the representation of FIG. 2, in which the injection valve is designed as a seat-hole nozzle.

DESCRIPTION OF THE EXEMPLARY EMBODIMENTS

The fuel injection valve for internal combustion engines, which is represented in FIG. 1 by its components essential to the invention, has a cylindrical valve body 1 which projects with its end of reduced diameter into the combustion space of an internal combustion engine (not shown). Arranged in the valve body 1 is an axial bore 3 which merges on the combustion space side into a blind hole 21 in the valve body 1 via a conical region. Guided axially displaceably in this bore 3 is a piston-shaped valve member 5 having, at its lower end on the combustion space side, a conical sealing face 7, by means of which it cooperates with a conical valve seat face 9 of the valve body 1, said valve seat face being formed on part of the conical region. The valve member 5 has, on its shank, a cross-sectional widening which forms a pressure shoulder 11 and which has adjoining it, in the direction facing away from the valve sealing face 7, a valve member part of increased diameter which is guided sealingly on the wall of the bore 3. The part of smaller diameter of the valve member shank extends, starting from the pressure shoulder 11, as far as the sealing face 7, there remaining between the wall of the bore 3 and the valve member 5 an annular gap forming a pressure duct 13. This pressure duct 13 extends from a pressure space 15, formed by a cross-sectional widening of the bore 3 in the region of the pressure shoulder 11, as far as the valve seat 9, a pressure conduit 17 connectable to a fuel high-pressure pump (not shown) opening into the pressure space 15.

In order to apply the closing force of the injection valve, moreover, there is provided a return spring 19 which acts on that end of the valve member 5 facing away from the combustion space and which thus keeps said end pressed with its valve sealing face 7 against the valve seat face 9.

In the first exemplary embodiment represented in FIGS. 1 and 2, the fuel injection valve is designed as a so-called blind-hole nozzle. For this purpose, the closed end of the bore 3 forms the blind hole 21 which adjoins the valve seat face 9 on the combustion space side and of which the end on the combustion space Bide is preferably made spherical or dome-shaped. At least one injection duct 23 leads off from this spherical-segmental inner wall part of the blind hole 21 into the combustion space of the internal combustion engine to be supplied, the axis of said injection duct being tilted in the direction of the valve member 5 out of a perpendicular to the inner wall face of the blind hole 21, so that the wall of that region of the injection duct 23 located above in the represented longitudinal section and facing the valve seat 9 is at a smaller angle to the inner wall of the blind hole 21 than the wall of the region located below and facing away from the valve seat 9. The wall thickness of the valve body 1 in the region of the injection duct 23, said wall thickness essentially determining the axial extension of the injection duct 23, is between 0.6 mm and 1.4 mm.

To improve the formation of the injection jet and for as homogeneous a jet shape as possible, the entry regions of the injection duct 23 which lead off from the inner wall of the blind hole 21 are rounded, the radius RA of the rounding of the entry region near the valve seat being larger than the radius RB of the rounding of the entry region facing away from the valve seat 9.

At the same time, the upper radius RA is 0.02 to 0.3 times and the lower radius RB 0.01 to 0.05 times the diameter D of the injection duct 23. These radii tangent both to the inner wall of the blind hole 21 and to the walls of the injection duct 23 allow an optimum inflow of the high-pressure fuel into the injection duct 23, whilst avoiding swirls which are detrimental to the formation of the jet.

The fuel injection valve according to the invention works as follows.

In the closed state of the injection valve, the return spring 19 holds the valve member 5 with its sealing face 7 in bearing contact on the valve seat 9 counter to the static pressure of the fuel-filled pressure space 15.

For injection at the injection valve, the latter's pressure space 15 is loaded with high fuel pressure via the pressure conduit 17, and the pressure force now applied to the pressure shoulder 11 exceeds the force of the return spring 19 and lifts off the valve member 5 from the valve seat 9. The high-pressure fuel passes via the pressure space 15 and the pressure duct 13 to the valve seat 9 and, with the valve member 5 lifted off, flows along the latter into the blind hole 21. In the blind hole 21 of the bore 3, the fuel flows via the rounded entrances into the injection duct 23 and is thus injected into the combustion space of the internal combustion engine to be supplied. At the same time, the entry regions into the injection duct 23 which are provided with a radius RA, RB give rise to a uniform and directional injection jet. Since the greatest part of the injection quantity or the part having the highest flow velocity flows via the upper rounding near the valve seat 9, the radius RA of said upper rounding is larger than the lower radius RB.

At the end of injection, with the pressure space 15 relieved of high pressure, the valve member 5 is moved back onto the valve seat 9 by the return spring 19 in a known way.

The second exemplary embodiment represented in FIG. 3 differs from the first exemplary embodiment only in the type of injection valve which, there, is designed as a so-called seat-hole nozzle.

For this purpose, that end of the bore 3 which is on the combustion space side and is closed is designed in the form of a hollow cone, the cone flanks forming the valve seat face 9 and the valve member 5 coming to bear sealingly with its conical sealing face 7 against said cone flanks. The injection duct 23 leads off from the valve seat face 9, so that, when the injection valve is in the closed state, said injection duct is covered by the sealing face 7 of the valve member 5 and is thus closed. At the same time, in FIG. 3, the injection duct 23 is arranged perpendicularly to the valve seat face 9 forming part of the blind hole 21 and, similarly to the first exemplary embodiment shown in FIG. 2, has rounded entry regions, of which the upper rounding facing the pressure duct 13 has a radius RA and of which the lower rounding facing away from the pressure duct 13 has a radius RB, RA being 0.02 to 0.3 times and RB 0.01 to 0.05 times the diameter D of the injection duct 23. In the second exemplary embodiment, similarly to the first, the wall thickness of the valve body 1 in the region of the injection duct 23 is between 0.6 mm and 1.4 mm. By means of the design according to the invention of the injection duct 23 of the fuel injection valve, it is thus possible, in comparison with known injection valves, to generate a directional injection jet which, on entry into the injection duct, is not or is only a little swirled, the rounded entry regions not reducing the effective injection hole length.

The foregoing relates to preferred exemplary embodiments of the invention, it being understood that other variants and embodiments thereof are possible within the spirit and scope of the invention, the latter being defined by the appended claims.

What is claimed is:

1. A fuel injection valve for internal combustion engines, comprising a valve member (5) having a valve member shank which is guided axially displaceably in a bore (3) of a valve body (1) and which has, at one end on a combustion space side, a conical valve sealing face (7), said conical valve sealing face cooperates with a conical valve seat face (9) at an end of the bore (3) located on the combustion space side, a blind hole (21) adjoining said bore on the combustion space side, with a pressure space (15) that opens onto the valve seat (9) and which is located between said valve member shank and the wall of the bore (3), at least one injection duct (23) which leads off from an inner wall of the blind hole, said inner wall being located downstream of the valve seat (9), and of which a hydraulic connection to the pressure space (15) is closed by the valve member (5) and which, at an end of the injection duct (23) on the fuel inlet side, has a rounded end entry region which faces the pressure space (15) having a large radius (RA) and a lower rounded end entry region which faces away from the pressure space having a smaller radius (RB), wherein the rounded, entry space starting tangentially from the inner wall, merges tangentially into the wall of the injection duct (23), and wherein the radius (RA) of the rounded end in the upper entry region is 0.02 to 0.3 times a diameter D of the injection duct (23) and the radius (RB) of the rounded end in the lower entry region is 0.01 to 0.05 times the diameter (D) of the injection duct (23).

2. The fuel injection valve as claimed in claim 1, wherein the wall thickness of the valve body (1) in the region of the injection duct (23) is 0.6 to 1.4 mm.

3. The fuel injection valve as claimed in claim 1, wherein that end of the bore (3) which adjoins the valve seat face (9) on the combustion space side, limits the blind hole (21) and the closed end is made dome-shaped, and wherein the injection duct (23) is arranged in a region of a spherical-segmental inner wall part of the blind hole (21) which is located outside an overlap with the valve member (5).

4. The fuel injection valve as claimed in claim 3, wherein the fuel injection duct (23) is arranged in such a way that a mid-axis of the injection duct is at an angle to a perpendicular to the spherical-segmental inner wall face, the injection duct (23), on an upper wall end facing the valve seat (9), being at a smaller angle to the perpendicular to the wall of the blind hole (21) than on its lower wall end face facing away from the valve seat (9).

5. The fuel injection valve as claimed in claim 1, wherein that end of the bore (3) which adjoins the valve seat face (9) on the combustion space side and which is closed is designed in the form of a hollow cone, and wherein the injection duct (23) leads away from a cone face part forming the valve seat face (9), so that said injection duct can be closed by the sealing face (7) of the valve member (5).

6. The fuel injection valve as claimed in claim 5, wherein the injection duct (23) is arranged perpendicularly to the valve seat face (9).

* * * * *